United States Patent [19]

Kriechbaum et al.

[11] Patent Number: 4,845,812

[45] Date of Patent: Jul. 11, 1989

[54] DEVICE FOR THE AUTOMATIC OPENING AND MIXING OF FIBER BALES

[75] Inventors: Kurt Kriechbaum, Ingolstadt; Johann Walk, Eichstaett; Hans Landwehrkamp, Lenting; Rudolf Reeber, Iggensbach, all of Fed. Rep. of Germany

[73] Assignee: Schubert & Salzer, Ingolstadt, Fed. Rep. of Germany

[21] Appl. No.: 115,752

[22] Filed: Nov. 2, 1987

[30] Foreign Application Priority Data

Nov. 4, 1986 [DE] Fed. Rep. of Germany ..... 3637578

[51] Int. Cl.[4] ..... D01G 7/10

[52] U.S. Cl. ..... 19/80 R; 19/81

[58] Field of Search ..... 19/80 R, 81

[56] References Cited

U.S. PATENT DOCUMENTS

| | | | |
|---|---|---|---|
| 4,000,541 | 1/1977 | Marzoli | 19/81 |
| 4,467,502 | 8/1984 | Lytton et al. | 19/80 R |
| 4,507,826 | 4/1985 | Keller et al. | 19/81 X |
| 4,660,257 | 4/1987 | Binder et al. | 19/80 R |
| 4,678,128 | 7/1987 | Hergeth | 19/80 R |

FOREIGN PATENT DOCUMENTS 3208346 9/1983 Fed. Rep. of Germany .

*Primary Examiner*—Werner H. Schroeder
*Assistant Examiner*—Sara M. Current
*Attorney, Agent, or Firm*—Dority & Manning

[57] ABSTRACT

The device for the opening and mixing of fiber bales contains a bale opening device capable of being lowered on a bale suspended from a bridge-like machine frame which is fashioned in the form of a portal and is capable of travelling along a guide rail, said bale opening device being equipped with a conveying device. A bale opening roll or plucker roll (6) is provided as the bale opening device, its axis of rotation being perpendicular to the direction of movement of the machine frame and its working width being at least 75% of the total width of the machine frame. A suction channel (9) fixedly installed above the bales (B) serves as the conveying device for the fiber material taken from the bales (B).

The device is of simple construction and has a usable opening width essentially equal to its overall width and makes it possible to achieve good fiber mixing.

29 Claims, 5 Drawing Sheets

DEVICE FOR THE AUTOMATIC OPENING AND MIXING OF FIBER BALES

BACKGROUND AND SUMMARY OF THE INVENTION

The instant invention relates to a device for automatic opening and mixing of fiber bales by means of a bale opening device which is suspended over the bales from the bridge of a machine frame made in the form of a portal and capable of travelling along a guide rail and of being lowered upon said bales, said bale opening device being futhermore equipped with a conveying device.

When fiber bales are opened automatically and the fibers are mixed, the possiblity must exist to open as great a number as possible of fiber bales. At the same time it should be possible to lay down the bales as easily as possible within the most limited amount of space without havnig to place the bales on special tables or similar supporting means. Furthermore, it should be possible to install the bale opening device in any plant area set aside for this purpose without much floor space being used. Devices for the automatic opening and mixing of fiber bales having a tower-like machine frame on which the bale opening device is attached on one side in the form of a boom are known in published German Patent application number 3,208,346. The entire travelling and lifting mechanisms, including the conveying device for the removal of the opened fiber material are installed in this machine frame. For reasons of stability alone, this machine frame occupies much space in relation to the working width of the bale opening device, space which is lost to the placement of bales. To utilize this lost space fully, it is usually used for the pneumatic or mechanical conveyors which remove the opened fiber material. Such a conveyor belt or conveyor channel makes it impossible to reach from that side, the area on which the bales are laid upon.

Another device is known in U.S. Pat. No. 4,000,541, in which the machine frame consists of a bridge supported on both sides, from which the actual bale opening device is suspended.

Here too, the conveying and driving means, as well as a weighing device, are contained in one of the machine frame sides which support the bridge. The fiber material is conveyed in a perpendicular direction to the sense of travel of the machine frame to this weighing device, in which a fiber mixing process is effected according to weight, and from which the material, mixed by weight, is dropped on a conveyor belt running alongside the path of travel of the machine frame. All of these devices have in common that they are extraordinarily costly and also reduce accessibility and hinder the positioning of the bales to a great extent. The space requirements are very great in relation to the working width.

The object of the instant invention is to create a device for the automatic opening and mixing of fiber bales which is simple in its construction and utilizes the available space to the fullest extent while avoiding the above-mentioned disadvantages.

This object is achieved according to the invention in that the bale opening device is a plucker roll, the rotational axis of which is perpendicular to the direction of movement of the machine frame and the working width of which comes to at least 75% of the overall width of the machine frame.

In a further embodiment of the device according to the invention a bridge is provided which connects the two sidewalls to each other, said sidewalls being equipped with runners and being at a distance equal to at least two bale widths from each other. Due to the fact that the sidewalls hold, between them, five fiber bales laying side-by-side with their long sides touching, the mixing of the fibers is further improved and intensified. In a space-saving embodiment the thickness of the sidewalls is 30%, preferably 20% of the working width of the plucker roll since they are essentially used only as supports and as an undercarriage. All the devices taking up space are located in the bridge and in the area of the bridge.

The plucker of bale opening roll of the invention is advantageously supported on a side capable of being lifted and lowered. The movement of the slide in a vertical direction is made possible by the fact that the slide is suspended at its two ends from chain-like drive transmitting elements which are laid over a common drive shaft. The movement of the slide in a defined plane is achieved by guiding the slide in straight guides in the sidewalls. The fact that runners of the machine frame are driven synchronously by chains or toothed belts ensures trouble-free travel capability of the device.

To prevent flying fibers and for reasons of safety, the drive-transmitting elements are installed in the sidewalls of the machine frame. To save space, the drive motors of the slide and the runners are installed in the bridge. Any torsion of the driven shafts is compensated by the fact that the drive motors transmit their drive force to the shafts near the center between the sidewalls.

A limitation of the quantity of fibers removed by the bale opening roll is achieved by installing holding-down rolls on the slide, parallel to the bale opening roll and in its proximity. The holding-down rolls are preferably driven at the travelling speed of the machine frame.

In a further, space-saving embodiment of the device, the drive motors used to rotate the bale plucker roll and the holding-down rolls are supported on the slide. Due to the fact that the bale plucker roll is equipped with a rake-like stripping element extending over its working width and located behind said bale plucker roll in relation to its direction of rotation, excess fiber quantities are stripped from the bale opening roll and are conveyed back to the bale surface.

Air pollution by flying fibers and dust is prevented by the fact that the area between the bridge and the slide is closed off by a cover extending over the working width of the bale plucker roll. The cover consists of at least one covering metal sheet which is guided in the sidewalls and can be moved up and down by the slide in the manner of a window blind. However, two cover metal sheets overlapping each other and fitting space-savingly into the bridge when the side is in its uppermost position are preferably used as the cover.

In a preferred, even more space-saving further embodiment of the device according to the invention, a suction channel is provided in a fixed position above the bales and is the conveying device for the fiber material taken from the bales. Good access from all sides is thereby provided to the surface on which the bales are laid down.

Uniform removal, by suction of the fiber material taken from the bales, over the entire working width of the bale opening roll, is achieved through the fact that the suction channel is connected by conduits to two suction openings in a suction hood covering the bale plucker roll. The removal by suction of the fiber material, also in the outermost end zones, is ensured through the fact that the suction openings are located near the ends of the bale plucker roll. In order to enable the conduits to follow the vertical movement of the bale plucker roll and of the suction hood, they are made at least in part in the form of telescoping bellows. The connection between the conduits and the suction channel is preferably established so that the conduits end in movable connection openings lying across from each other which are part of a longitudinal slit in the suction channel, the slit being capable of being closed by a covering band. The movable connection openings are preferably located on a carriage coupled to the machine frame via fork-like carriers.

Secure closing of the longitudinal slit, even when negative pressure is not present in the suction channel, is achieved through the fact that the covering band is held in closing position by magnetic force. The path of travel of the machine frame is preferably adjustable by means of a pulse counter installed on the suction channel. The impulse counter is thus protected from damage.

DETAILED DESCRIPTION OF THE PREFERRED EMBODIMENTS

Figure 1:
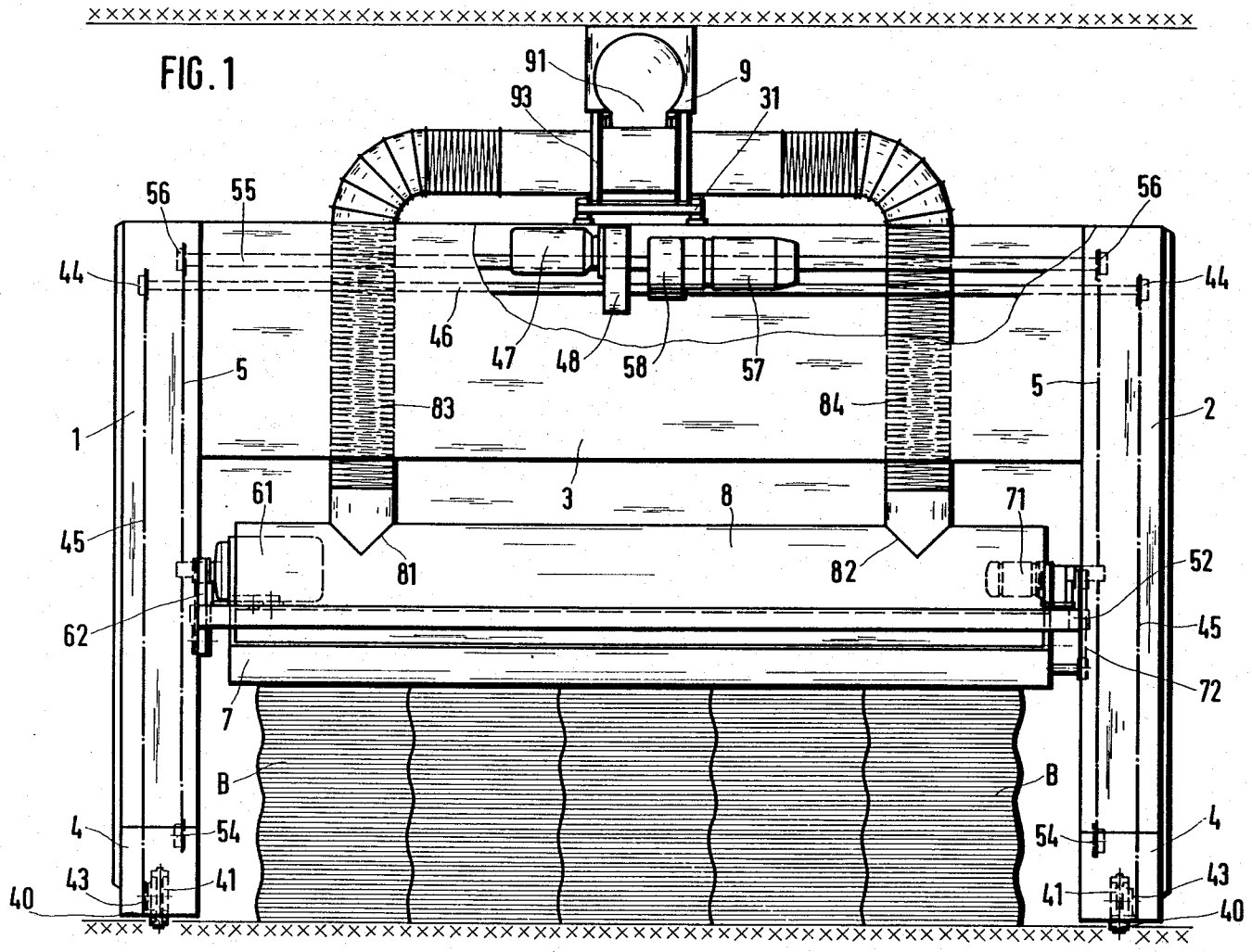
FIG. 1 is a front view of a bale opening device in an embodiment according to the invention.
Figure 2:
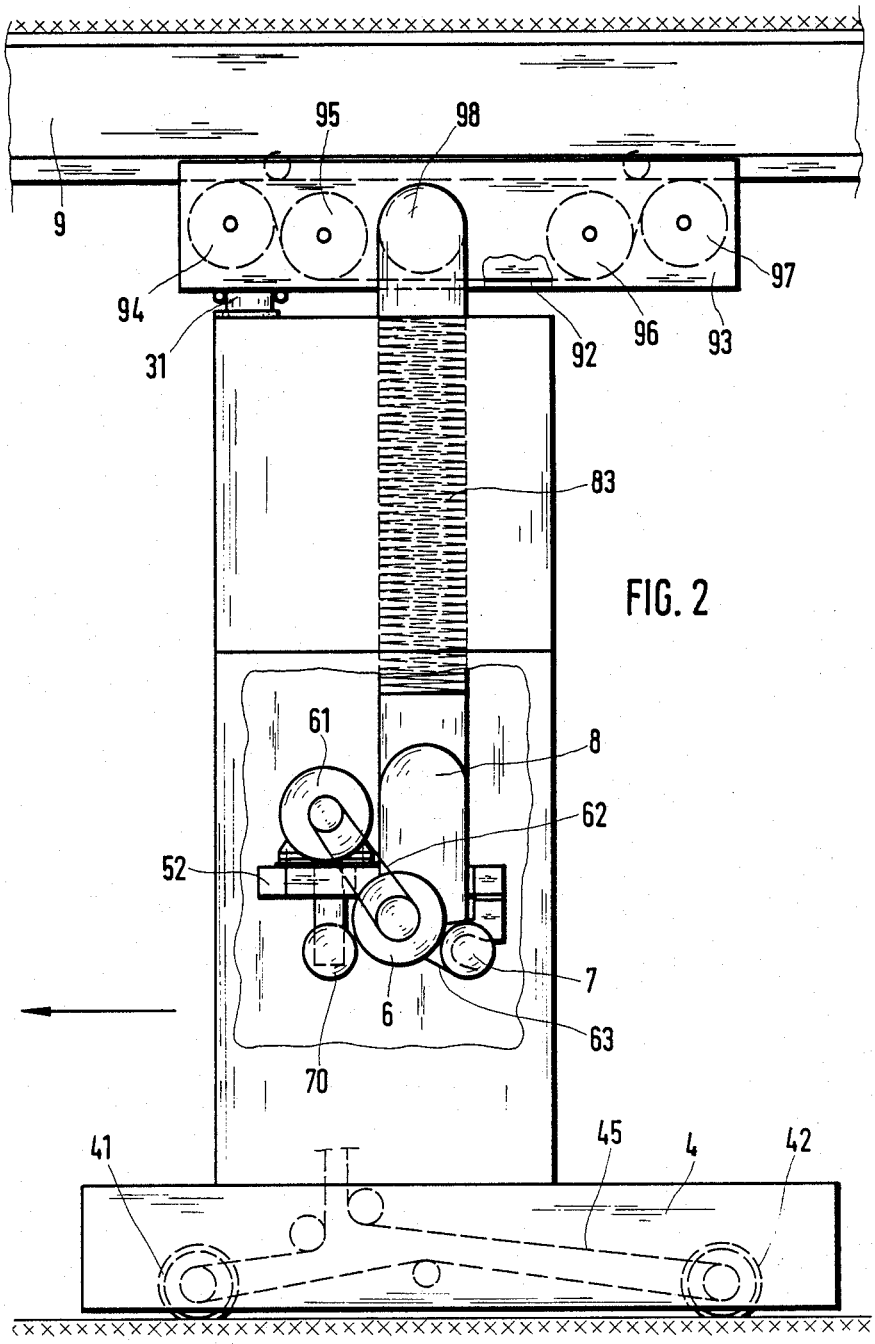
FIG. 2 is a side view of the device in FIG. 1.

The bale opening device shown in FIGS. 1 and 2 consists of a machine frame with two narrow sidewalls 1 and 2 which are connected to each other via a bridge 3. The sidewalls 1 and 2 are mounted on an undercarriage 4 equipped with rollers 41 and 42 or are integrated into said undercarriage. The rollers 41 and 42 are guided in grooves 40 are driven synchronously. For that purpose they are connected to a drive shaft 46 via chain wheels 43 and 44 and chain pinions 45 installed in the sidewalls 1 and 2 which engage said chain wheels 43 and 44. Drive shaft 46 is driven by toothed gear 48 by a motor 47 which is located in the bridge 3. Motor 47 and the drive shaft 46, as well as all other drive means yet to be mentioned, are located above the bales B to be opened in order to save space.

The distance between the sidewalls 1 and 2 is at least equal to two bale widths. As a rule the cotton bales B, which are opened, are rectangular in shape and are arranged in a row on the floor between the sidewalls 1 and 2 in such manner that their long sides which touch each other are essentially parallel to the grooves 40. However, in view of improved fiber mixing, a distance is provided between the sidewalls 1 and 2 which makes it possible to lay down five fiber bales B next to each other between them, as is shown in FIG. 1.

The bale opening device consists of a bale plucker roll 6 in the form of a rotating beater, the rotational axle of which is perpendicular to the direction of movement of the machine frame. The working width of the bale plucker roll 6 is at least 75% of the total width of the machine frame and the thickness of the sidewalls 1 and 2 is 30%, but preferably 20% of the working width of the bale plucker roll 6. The bale plucker roll 6, as well as two holding down rolls 7 and 70, are supported in a slide 52 which is suspended at its two ends from chains 5 or chainlike elements, and which are capable of sliding up and down in vertical guides (not shown) provided in the sidewalls 1 and 2. The holding down rolls 7 and 70, equipped with toothed disks, are located directly in front of, and behind the bale plucker roll 6 and parallel to it. Furthermore, a suction hood 8 covering the bale plucker roll 6 is attached to the slide 52.

Figure 6:
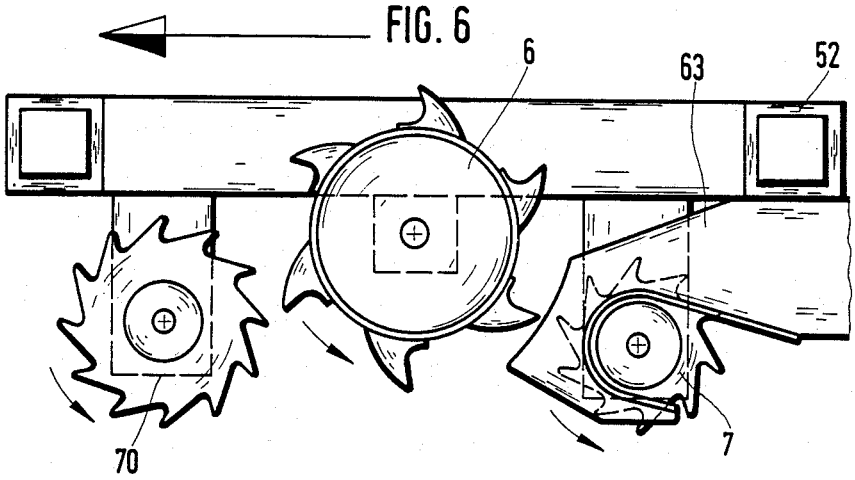
FIG. 6 is a view of the bale plucker roller with its scraping rake.

The chains 5, from which the slide 52 is suspended, as well as the drive chains 45 for the machine frame, are installed in the sidewalls 1 and 2 to save space and for reasons of safety. Each of the chains 5 is guided over a fixed sprocket 54 near the floor and over a sprocket 56 seated on a drive shaft 55, located above bale B. A motor 57, located on the bridge 3, drives the drive shaft 55 via a toothed gearing 58, causing the slide 52 and thereby the bale plucker roll 6 with its corresponding holding-down rolls 7 and 70 as well as the suction hood 8 to be moved vertically. A motor 61, supported on the undercarriage 2, causes the bale plucker roll 6, extending from wall to wall, to rotate via a belt drive 62. The holding-down rolls 7 and 70 are rotated at the speed of travel of the machine frame by a motor 71 supported on slide 52. A toothed timing belt 72 is used as the drive transmitting means. The holding-down rolls 7 and 70 rotate in the same direction as the bale plucker roll 6 (FIG. 6). As can be seen from FIG. 1, the two drive motors 47 and 57 are installed on the bridge 3 close to the center between the sidewalls 1 and 2, and torsion of shafts 46 and 55 is thereby compensated.

Figure 3:
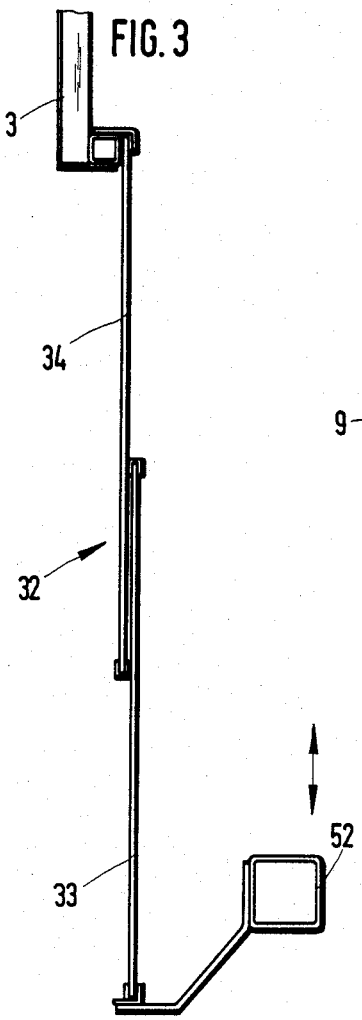
FIG. 3 is a side view of a cover with two sheet-metal cover plates.

The area between the bridge 3 and slide 52 is closed by a cover 32, shown in FIG. 3, which prevents flying fibers and dust from reaching the outside. Cover 32 is constituted by two smooth pieces of sheet metal 33 and 34 reaching over the working width of the bale plucker roll 6 and capable of sliding in vertical guides in the sidewalls 1 and 2. The lower metal sheet 33 rests on a console of slide 52. The guides for the upper metal sheet 34 are offset with respect to the guides for the lower metal sheet 33 and extend downward sufficiently so that the metal sheets 33 and 34 still overlap even when slide 52 is completely lowered. The metal sheets 33 and 34 are taken along by the slide 52 which moves in a vertical direction and are moved up and down in the manner of sliding window sashes so that the area between the slide 52 and the bridge 3 remains closed in any position of said slide 52. When the slide 52 is in the raised position the two sheet metal covers 33 and 34 fit inside the bridge 3. If necessary, the cover 32 can also consist of one single piece of sheet metal.

The suction hood 8 has two suction openings 81 and 82 which are located preferably near the ends of the bale plucker roll 6 and which are connected via a conduit 83 and 84 to a suction channel 9 located above bale B. As can be seen especially in FIG. 1, the conduits 83 and 84 are made at least in some areas in the form of extensible bellows. Due to this they are able to follow the ascending and descending movement of the bale opening device without danger of jamming. In addition, misalignments can be compensated for in this way. The arrangements of the suction channel 9, as shown in FIG. 1, approximately in the center above bale B, is preferred for reasons of work flow and space saving. This does not, however, preclude an arrangement at the side of the bales, possibly also at a low height.

Figure 4:
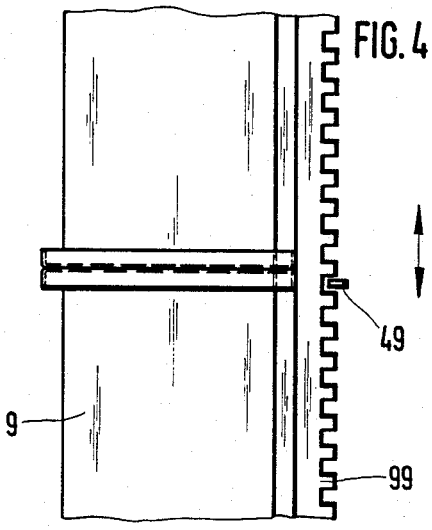
FIG. 4 is a top view of a section of a suction channel with a pulse counter.
Figure 5:
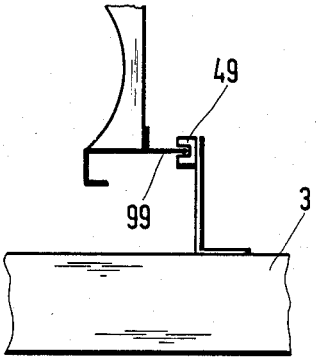
FIG. 5 is a front view of the device in FIG. 4.

The suction channel 9 extends in the direction of the row of bales over its entire length and is provided with a longitudinal slit 91 which faces the bales B and which is closed by a covering band 92 (FIG. 2). The covering band 92 is made of spring steel and is held in a covering position by magnetic force. A slide 93, suspended from suction channel 9, supports the defleciton pulleys 94, 95 and, at a distance from these, the additional deflection pulleys 96, 97 over which covering band 92 is guided in such manner that it leaves the connection openings 98 which face each other into which the two conduits 83 and 84 end uncovered. Slide 93 is coupled to bridge 3 via fork-like carriers 31, which are attached to said bridge 3 and are displaced by the latter along the suction channel 9 when the bale opening device begins to move. Attached to suction channel 9 (and thus protected from damage) is a pulse counter device 49 by which the travelling path of the machine frame is determined is also provided (FIGS. 4 and 5). The pulses are caused by notches 99 which are made at even distances on a flange of suction channel 9. The pulse counter is fixedly attached to bridge 3, as shown in FIG. 5, and is thus displaced along the notches 99 with the movement of the bale opening device.

In operation the device is driven by motor 47 via chain drives 45 at a preset travelling speed in the direction of the arrow (FIGS. 2 and 6), whereby the bale plucker roll 6, which was first lowered together with the holding-down rolls 7 and 71 upon the surface of the bale, removing fiber material from the bale and flings it towards the suction hood 8, against the direction of travel. The fiber material is seized by the suction air stream in proximity of hood 8 and is conveyed through the conduits 83 and 84 into suction channel 9 for further removal. Since the fiber material is taken out of two, and preferably five fiber bales B and is sucked away, a mixing of fibers occurs as early as the time of fiber removal under the effect of the suction air stream.

Figure 7:
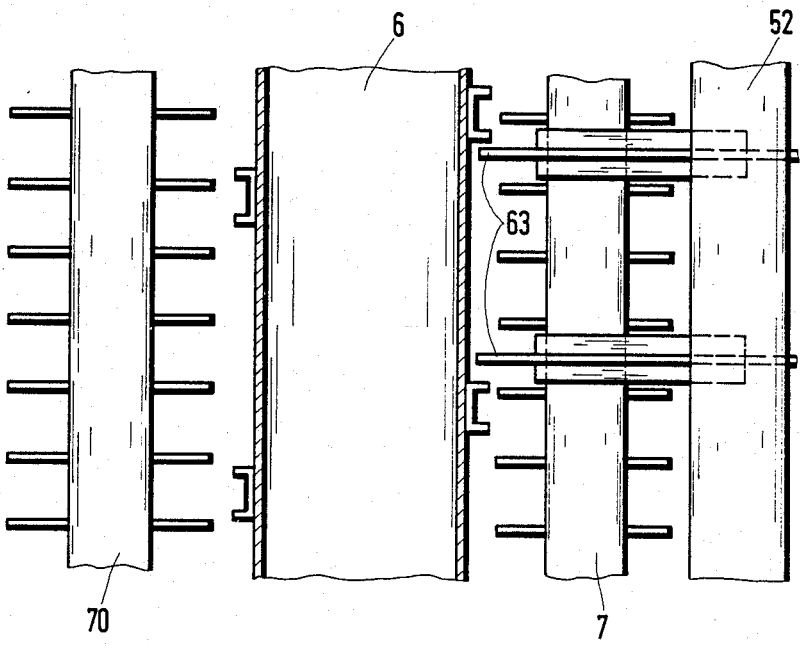
FIG. 7 is a top view of the device in FIG. 6.

The holding-down rolls 7 and 70, which press down on the bale surface and are driven by motor 71 at the travelling speed of the machine frame, limit the amount of fiber material which is removed and neutralize force components acting in the direction for removal. If necessary, the bale plucker roll 6 can be further equipped with scraping elements 63 in a rake-like arrangement (FIGS. 6 and 7) to convey fiber material which has been taken up the bale plucker roll and has remained unopened back to the surface of the bale.

The scraping elements 63 are attached on the slide 52, behind the bale plucker roll 6 with respect to its direction of rotation, whereby its points are arranged at a predetermined, adjustable distance from the beating circle of the bale plucker roll 6, but can also be adjusted so as to reach into the beating circle, if the location of the rows of teeth on the bale plucker roll permits this.

Figure 8:
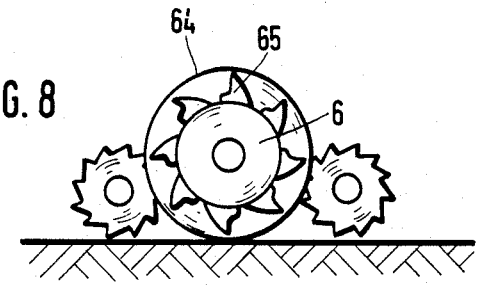
FIG. 8 is a side view of a bale plucker roll equipped with border disks.
Figure 9:
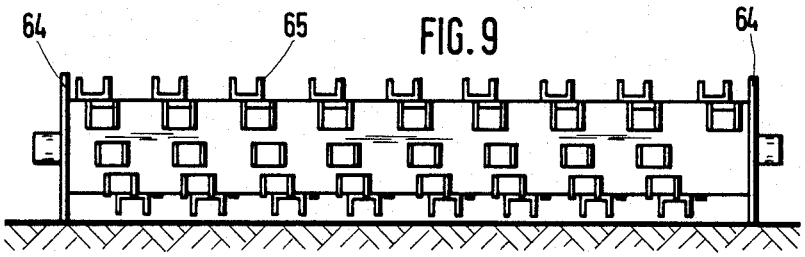
FIG. 9 is a front view of the bale plucking roll in FIG. 8.

Furthermore, border disks 64 can be installed at the two ends of the bale plucker roll 6, their diameter being somewhat larger than the diameter of the circle of points of the teeth 65 attached on the circumference of the bale plucker roll 6 (FIGS. 8, 9). The border disks 64 rest on the floor when the last layer of fibers is taken from the bales and they ensure that the teeth 65 of the bale plucker roll 6 rotate at some distance from the floor. Damage to the teeth 65 is thus prevented.

Figure 10:
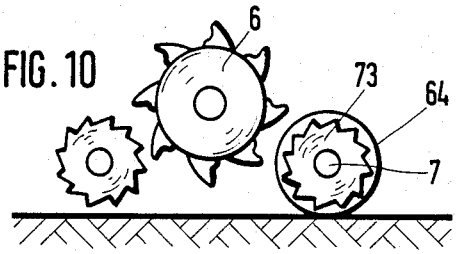
FIG. 10 is a side view of a holding-down roll equipped with border disks.
Figure 11:
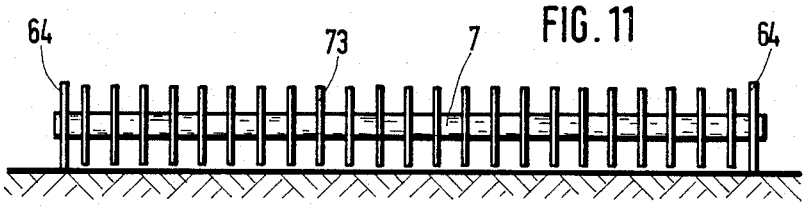
FIG. 11 is a front view of the holding-down roll in FIG. 10.

In another embodiment of the invention, designed to serve the same purpose, such border disks are installed at least on one of the holding-down rolls. The holding-down rolls 7 shown in FIGS. 10 and 11 is provided with border disks 64. In this case, the border disks 64 have a larger diameter than that of the circle of points of the teeth of toothed disks 73. Due to the fact that all devices which take up space are installed outside the side pieces 1 and 2 but within bridge 3 or else in proximity of bridge 3, it is possible to keep the side pieces narrow. They are mainly supports and serve as an undercarriage.

What is claimed is:

1. An apparatus for opening and mixing fibers, plucked from a plurality of fiber bales, comprising:

(a) a framework, having two spaced side members, each of which is supported for reciprocating movement alongside a plurality of bales of fiber, and further having a bridge member supported by said side members and extending over the surfaces of said bales of fiber;

(b) a bale opening device, suspended from said bridge member for vertical movement relative to said bridge member, and having a pale plucking roll, the longitudinal axis of which is perpendicular to the direction of movement of said framework;

(c) means for rotating said plucking roll to pluck fibers from the surfaces of said bale as said framework reciprocates over said bales; and (d) suction means, situated generally above said plucking roll, for receiving plucked fiber and for conveying it to fiber processing machines, said suction means including a suction hood coveri+ng said plucking roll with a pair of suction opening generally adjacent respective ends of said plucking roll and associated with respective suction conduits.

2. Apparatus as set forth in claim 1, wherein said sidewalls are spaced a distance from each other which is equal to the width of at least two bales of fiber.

3. Apparatus as set forth in claim 1, wherein said framework encloses at least 5 bales of fiber in a row next to each other with their long sides in abutting contact.

4. An apparatus as set forth in claim 1, wherein the working width of said bale plucking roll is at least 75% of the overall width of said framework, and the combined thickness of said sidewalls is not more than 30% of the working width of said plucker roll.

5. Apparatus as set forth in claim 1, wherein said bale plucking roll is supported on a slide which is capable of vertical reciprocating motion.

6. Apparatus as set forth in claim 5, wherein the slide is suspended at its two ends from a chain-like drive transmitting elements which go around a common drive shaft.

7. Apparatus as set forth in claim 5, wherein the slide is guided by means of straight guides in the sidewalls.

8. Apparatus as set forth in claim 1, wherein said side members are supported on rollers which are driven in synchronism through chains.

9. Apparatus as set forth in claim 6, wherein said drive transmitting elements are disposed in the sidewalls of the machine framework.

10. Apparatus as set forth in claim 5, wherein drive motors for the slide and for the rollers are disposed on the bridge.

11. Apparatus as set forth in claim 10, wherein said drive motors are located substantially in the center of said bridge member at a point intermediate the sidewalls.

12. Apparatus as set forth in claim 1, wherein two holding-down rolls are disposed on the side and have longitudinal axis which are parallel to the longitudinal axis of said plucking roll.

13. Apparatus as set forth in claim 12, wherein said holding-down rolls are driven at the reciprocating movement speed of the framework.

14. Apparatus as set forth in claim 5, wherein the slide supports the drive motors for rotating the plucker roll and the hold-down rolls.

15. Apparatus as set forth in claim 1, wherein the bale plucking roll is equipped with a scraping element of rake-like design which is effective over its working width and which is located behind said bale plucking roll in relation to its direction of rotation.

16. Apparatus as set forth in claim 1, wherein the area between said bridge member and the slide is closed by a cover extending over the working width of said bale plucking roll.

17. Apparatus as set forth in claim 16, wherein the cover comprises at least one covering metal sheet which is guided in the sidewalls and which can be moved up and down by the slide in the manner of window sashes.

18. Apparatus as set forth in claim 16, wherein two overlapping metal sheets make a cover.

19. Apparatus as set forth in claim 1, wherein said suction means comprises a suction channel installed above the bales for receiving and conveying the fiber material removed from said bale.

20. Apparatus as set forth in claim 19, wherein the suction channel is located in the center above the bridge.

21. Apparatus as set forth in claim 20, wherein the suction channel is connected by said suction conduits of said suction openings in said suction hood which covers the bale plucking roll.

22. Apparatus as set forth in claim 21, wherein the conduits comprise at least in part, extendable bellows.

23. Apparatus as set forth in claim 21, wherein the conduits end in movable connection openings located across from each other, and which are a part of a longitudinal slit in the suction channel which is adapted to be enclosed by a covering band.

24. Apparatus as set forth in claimm 23, wherein the movable connection openings are located on a slide which is coupled to the framework via fork-like carriers.

25. Apparatus as set forth in claim 23, wherein the covering band is held in closed position by magnetic force.

26. Apparatus as set forth in claim 19, wherein the path of travel of the machine framework is determined by a pulse counter installed on the suction channel.

27. Apparatus as set forth in claim 21, wherein the conduits connecting the suction channel to the suction hood are located outside the sidewalls in the areas of the bridge member.

28. Apparatus as set forth in claim 1, wherein border disks are installed at the end of the bale plucking roll, each of said broder disks having a diameter which is greater than the diameter formed by the end of teeth located on said plucking roll.

29. Apparatus as set forth in claim 12, wherein border disks are installed at the end of at least one of said holding-down rolls, each of said border disks having a diameter which is greater than the diameter formed by the end of teeth disposed on the surface of said hold-down rolls.

* * * * *